US010493639B2

(12) United States Patent
Medhurst

(10) Patent No.: US 10,493,639 B2
(45) Date of Patent: Dec. 3, 2019

(54) FOLDING UTILITY KNIFE

(71) Applicant: Simon Medhurst, Burlington (CA)

(72) Inventor: Simon Medhurst, Burlington (CA)

( * ) Notice: Subject to any disclaimer, the term of this patent is extended or adjusted under 35 U.S.C. 154(b) by 3 days.

(21) Appl. No.: 15/960,801

(22) Filed: Apr. 24, 2018

(65) Prior Publication Data

US 2019/0321991 A1 Oct. 24, 2019

(51) Int. Cl.
*B26B 1/02* (2006.01)
*B26B 5/00* (2006.01)
*B26B 1/08* (2006.01)

(52) U.S. Cl.
CPC ..... *B26B 1/02* (2013.01); *B26B 1/08* (2013.01); *B26B 5/003* (2013.01)

(58) Field of Classification Search
CPC .... B26B 1/08; B26B 1/02; B26B 1/04; B26B 5/00; B26B 5/001; B26B 5/003; B26B 5/006; B26B 5/002
See application file for complete search history.

(56) References Cited

U.S. PATENT DOCUMENTS 2,074,640 A * 3/1937 Christy ..... B26B 1/08 30/162
6,688,003 B2 * 2/2004 Scarla ..... B26B 1/02 30/156
7,337,546 B2 * 3/2008 Cheng ..... B26B 1/04 30/156
7,814,664 B2 * 10/2010 LeBlanc ..... B26B 5/00 30/156
8,935,855 B2 * 1/2015 Qiu ..... B26B 5/00 30/156
10,046,466 B2 * 8/2018 Wang ..... B26B 5/00
10,144,139 B2 * 12/2018 Squiers ..... B26B 5/003
2005/0204567 A1 * 9/2005 Ping ..... B26B 1/042 30/161
2007/0245574 A1 * 10/2007 Green ..... B26B 9/00 30/346.5
2014/0101943 A1 * 4/2014 Chu ..... B26B 1/08 30/162
2014/0208596 A1 * 7/2014 Constantine ..... B26B 1/08 30/162
2017/0120463 A1 * 5/2017 Pelletier ..... B26B 5/003

* cited by examiner

*Primary Examiner* — Jennifer B Swinney
(74) *Attorney, Agent, or Firm* — Patrick J. Hofbauer

(57) ABSTRACT

A folding utility knife comprises a handle, an angularly movable blade holder, blade holder locking mechanism and a cutting blade with a cutting edge and an opposite indexing edge having a first indexing notch, a second indexing notch and a third indexing notch. A blade locking mechanism has a locking pin for locking engagement with the first indexing notch, the second indexing notch, and the third indexing notch holds the cutting blade in a first blade position, a second blade position and a third blade position, respectively. The cutting blade is removable and rotatable 180 degrees for re-insertion into the blade holder whereat locking engagement of the locking pin with the third indexing notch, the second indexing notch, and the third indexing notch holds the cutting blade in a fourth blade position, a fifth blade position and a sixth blade position, respectively.

10 Claims, 22 Drawing Sheets

FOLDING UTILITY KNIFE

FIELD OF THE INVENTION

The present invention relates to folding knives, and more particularly to folding utility knives with reversible blades having a plurality of blade positions within a blade holder.

BACKGROUND AND SUMMARY OF THE INVENTION

The inventor herein is a pioneer in the area of utility knives, and more specifically in folding utility knives, that are typically used in various trades and by home handymen. The majority of such utility knives typically provide for the use of a single type of cutting blade, typically being the standard quadrilateral-shaped utility blades having upper and lower parallel edges, the lower of which is sharpened to form a cutting edge and of generally longer length than the upper edge. The upper edge is typically unsharpened and has one or more notches designed to index with a holding means mounted in the body of the utility knife. The other two opposed edges are also typically unsharpened, and are generally shorter and angled congruently, but in opposite directions from one another, to provide for a reversible blade having two points.

The following documents represent the closest known prior art at the time of filing of this patent application.

United States Published Patent Application No. 2009/0217536, published Sep. 3, 2009 to Medhurst, the present inventor, and entitled HAND TOOL WITH INTERCHANGEABLE TOOL ELEMENTS, discloses a hand held cutting tool for use with a plurality of different tool elements. One blade is a standard quadrilateral-shaped utility knife blade having upper and lower parallel edges, the lower of which is typically sharpened to form a cutting edge as described immediately above. There are two notches in the unsharpened upper edge. When the conventional utility knife blade is fully inserted in a rearward sliding motion into its respective chamber, and the rocker member is thereafter pivoted to its locked configuration, a tooth on the rocker member engages the rearmost indexing notch utility knife blade to retain the utility knife blade in place. The utility knife blade cannot be slidably moved to more than one in-use position.

U.S. Pat. No. 8,935,855, issued Jan. 20, 2015 to Qui, and entitled UTILITY KNIFE AVOIDING ACCIDENTAL DETACHMENT OF BLADE, discloses a utility knife that a standard quadrilateral-shaped utility knife blade having upper and lower parallel edges, the lower of which is sharpened to form a cutting edge as described immediately above. There are two indexing notches in the unsharpened upper edge. A locking part on a tilting lock rod engages the rearmost indexing notch of the utility knife blade to retain the utility knife blade in place. The utility knife blade cannot be slidably moved to more than one in-use position.

United States Published Patent Application No. 2013/0255087, published Oct. 3, 2013 to Wang, and entitled UTILITY KNIFE WITH REPLACEABLE BLADE, discloses a utility knife with a replaceable blade, comprising a knife handle, a blade holder, a blade and a locking device that locks the utility knife blade in the blade holder. The blade holder and the blade are enabled to switch between a first position and a second position. When the blade holder and the blade are in the first position, the blade is used for cutting operation, and when the blade holder and the blade are in the second position, both the blade holder and the blade are received in the knife handle. A locking member on the locking device engages the rearmost indexing notch of the utility knife blade to retain the utility knife blade in place. The utility knife blade cannot be slidably moved to more than one in-use position.

U.S. Pat. No. 6,148,522, issued Nov. 21, 2000 to Dobandi, and entitled DUAL-BLADE UTILITY KNIFE, discloses a dual blade utility knife that includes double-ended, retractable, separately actuatable cutting blades. When the utility knife cutting blade is inserted into blade holder, the blade is stopped by a blade stop. The end tip of the blade holder fits inside rearmost recessed portion on the blade to hold it firmly in position. The utility knife blade cannot be slidably moved to more than one in-use position.

The inventor has, as an early adaptor of this technology, become aware of the need for further improvements in this area, and has become aware that through the present invention such further improvements are significant and can overcome various problems with the prior art and can meet needs that are apparent in the related art. To this end, it is an object of the present invention to provide an improved folding utility knife.

It is also an object of the present invention to provide an improved folding utility knife wherein the knife blade is slidable to a plurality of in-use positions.

It is also an object of the present invention to provide an improved folding utility knife wherein blade locking mechanism of the knife blade engages each of a plurality of notches in the indexing edge of the knife blade corresponding one each to the plurality of in-use blade positions.

It is also an object of the present invention to provide an improved folding utility knife that can effectively cut through both thin and thick objects by reason of having a larger range of usable cutting edge extendable from the front end of the blade holder than is possible with standard quadrilateral-shaped utility blades available in the prior art.

It is also an object of the present invention to provide an improved folding utility knife wherein the useful life of the cutting blade is longer than in prior art knives due to the availability of extra cutting blade length.

There is thus disclosed according to one aspect of the present invention a folding utility knife comprising a handle and a blade holder mounted on the handle for angular movement relative to the handle between a fully open position and a fully closed configuration. A blade holder locking mechanism is operatively interconnected between the handle and the blade holder for releasably locking the blade holder at the fully open position. A cutting blade extends longitudinally between a first blade end and a second blade end and has a cutting edge extending between the first blade end and the second blade end in opposed parallel relation to an indexing edge. The indexing edge has a first indexing notch, a second indexing notch and a third indexing notch spaced from one another along the indexing edge. A blade locking mechanism has a locking pin mounted on the blade holder for locking engagement with a selected one of the first indexing notch, the second indexing notch, and the third indexing notch to hold fast the cutting blade against longitudinal sliding movement within the blade holder, such that: i) locking engagement of the locking pin with the first indexing notch holds the cutting blade against the longitudinal sliding movement in a first blade position wherein the first end and a first short portion of the cutting edge is exposed for use; ii) locking engagement of the locking pin with the second indexing notch holds the cutting blade against the longitudinal movement in a second blade position wherein the first end and a first intermediate portion of the cutting edge is exposed for use; iii) locking engagement of the locking pin with the third indexing notch holds the cutting blade against the longitudinal movement in a third blade position wherein the first end and a first longer portion of the cutting edge is exposed for use; and such that the cutting blade is releasable from the locking engagement in the first, second and third blade positions to permit removal of the cutting blade from the blade holder and for rotation of the cutting blade through 180 degrees of rotation in a horizontal plane for re-insertion of the first end into the blade holder whereat: iv) locking engagement of the locking pin with the third indexing notch holds the cutting blade against the longitudinal movement in a fourth blade position wherein the second end and a second short portion of the cutting edge is exposed for use; v) locking engagement of the locking pin with the second indexing notch holds the cutting blade against the longitudinal movement in a fifth blade position wherein the second end and a second intermediate portion of the cutting edge is exposed for use; and, vi) locking engagement of the locking pin with the first indexing notch holds the cutting blade against the longitudinal movement in a sixth blade position wherein the second end and a second longer portion of the cutting edge is exposed for use.

The above and other objects, advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

PARTS LIST

Figure 1:
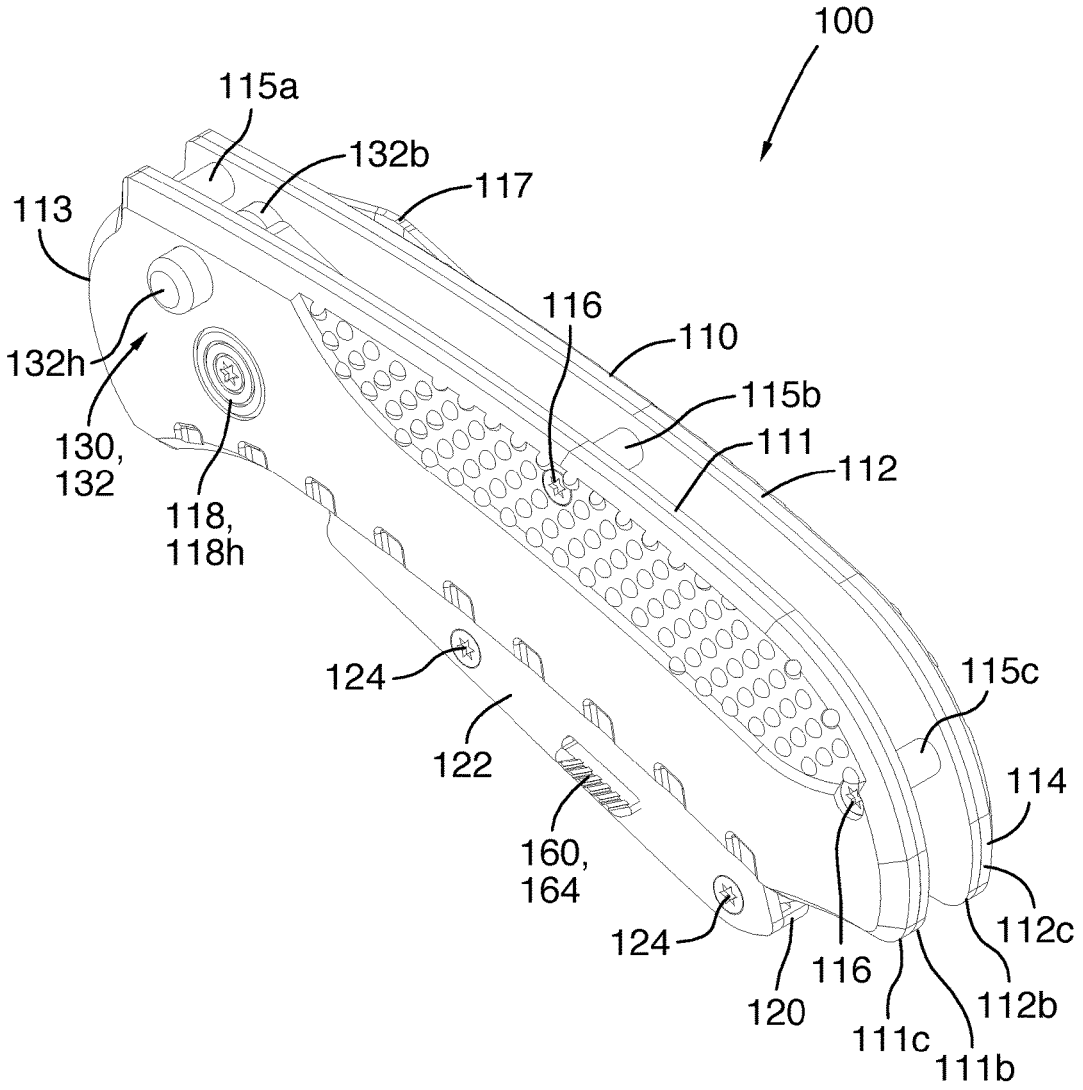
FIG. 1 is a perspective view from the rear of the first illustrated embodiment of the folding utility knife according to the present invention, with the blade holder in a fully closed configuration.
Figure 2:
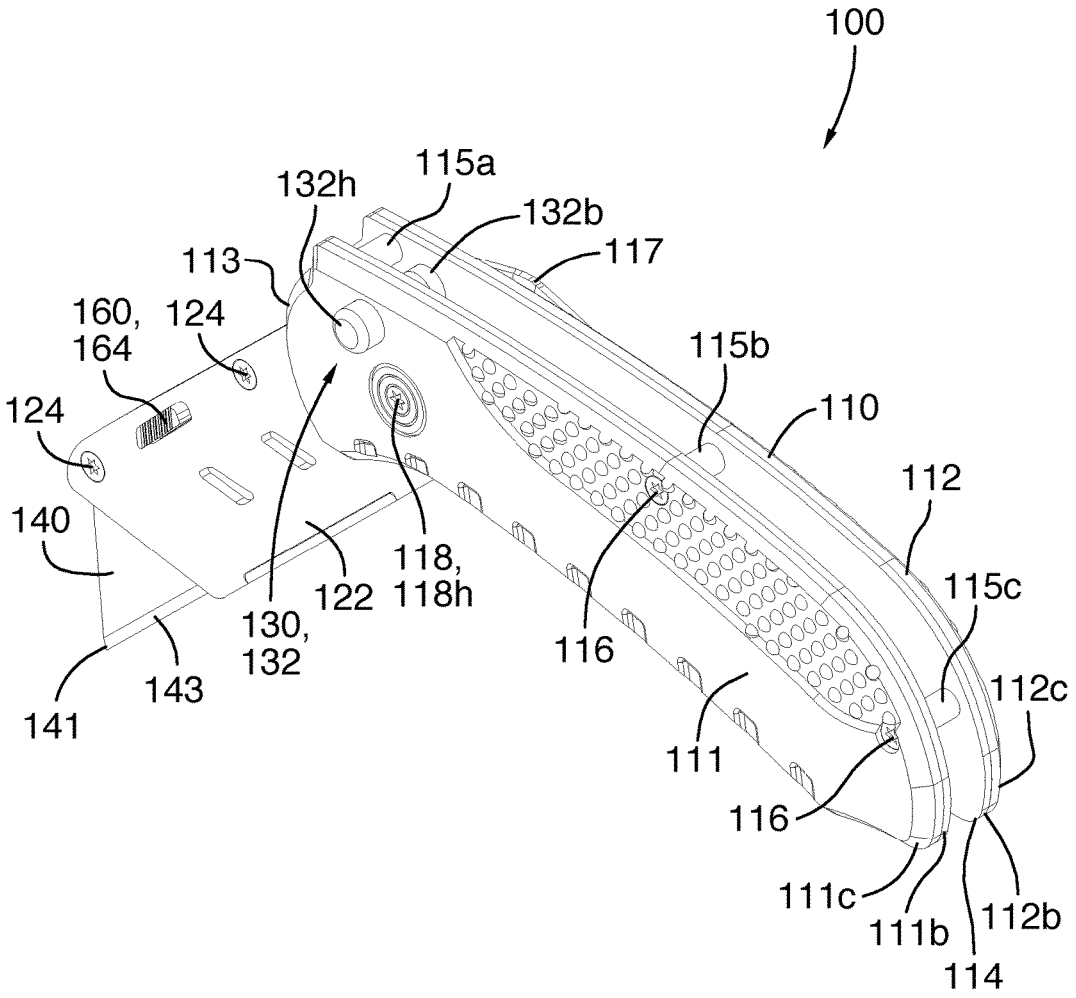
FIG. 2 is a perspective view from the rear of the first illustrated embodiment of the folding utility knife of FIG. 1, with the blade holder in an intermediate position.
Figure 3:
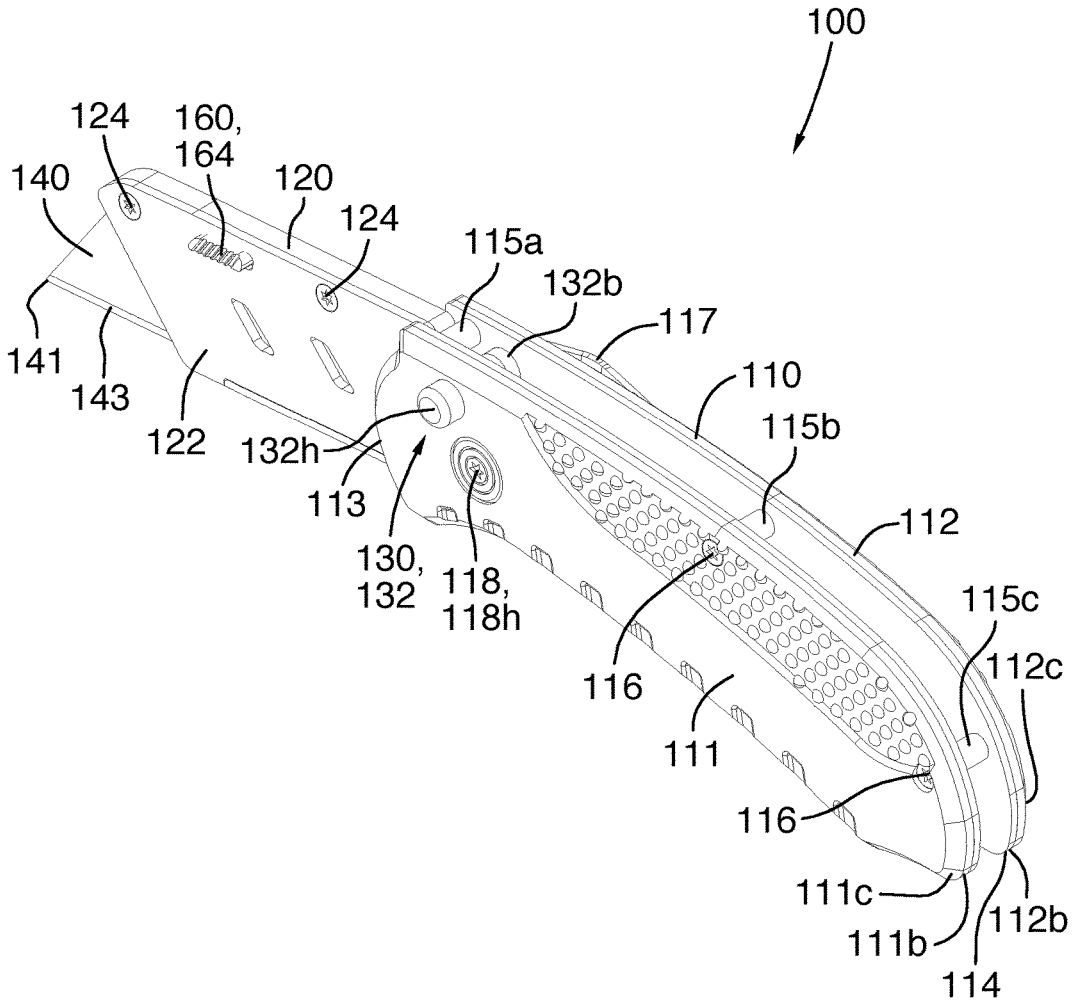
FIG. 3 is a perspective view from the rear of the first illustrated embodiment of the folding utility knife of FIG. 1, with the blade holder in a fully open position.
Figure 4:
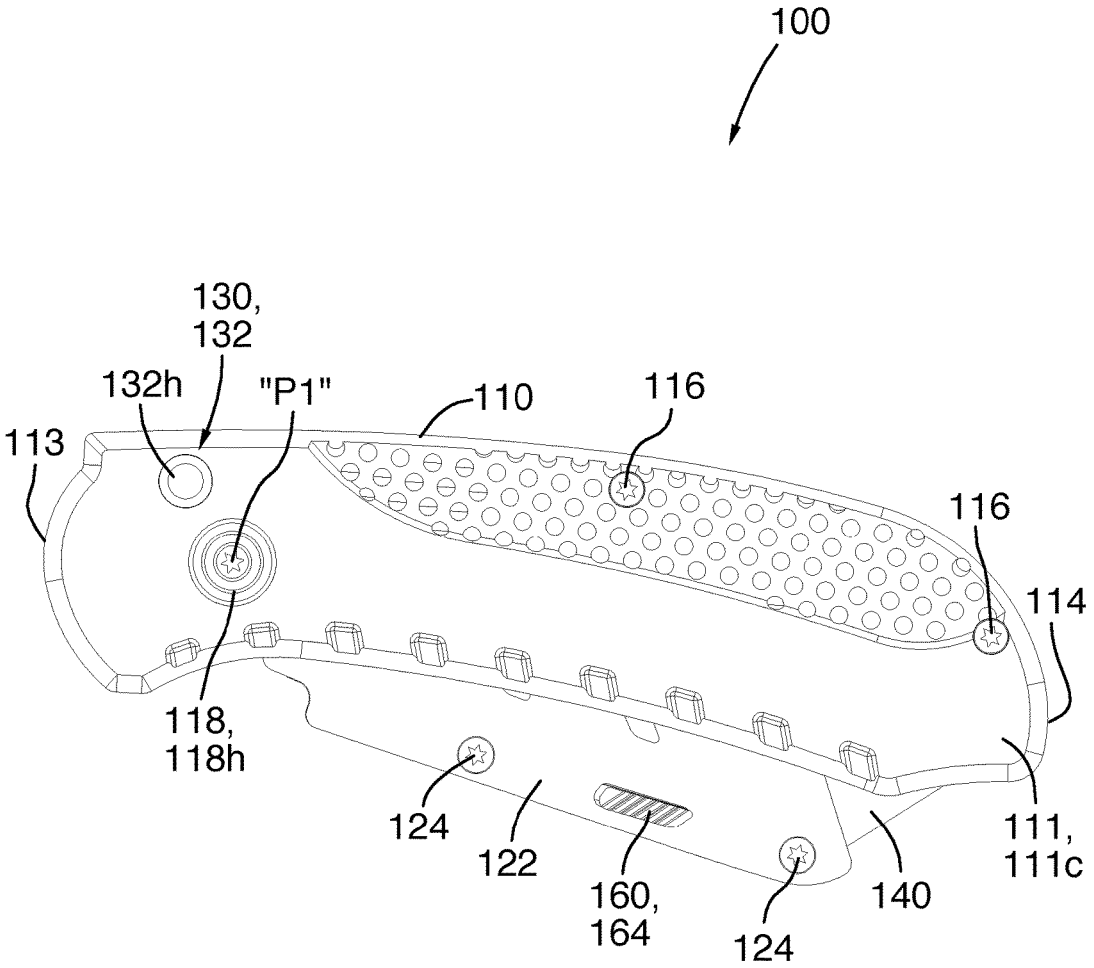
FIG. 4 is a left side elevational view of the first illustrated embodiment of the folding utility knife of FIG. 1, with the blade holder in a fully closed configuration.
Figure 5:
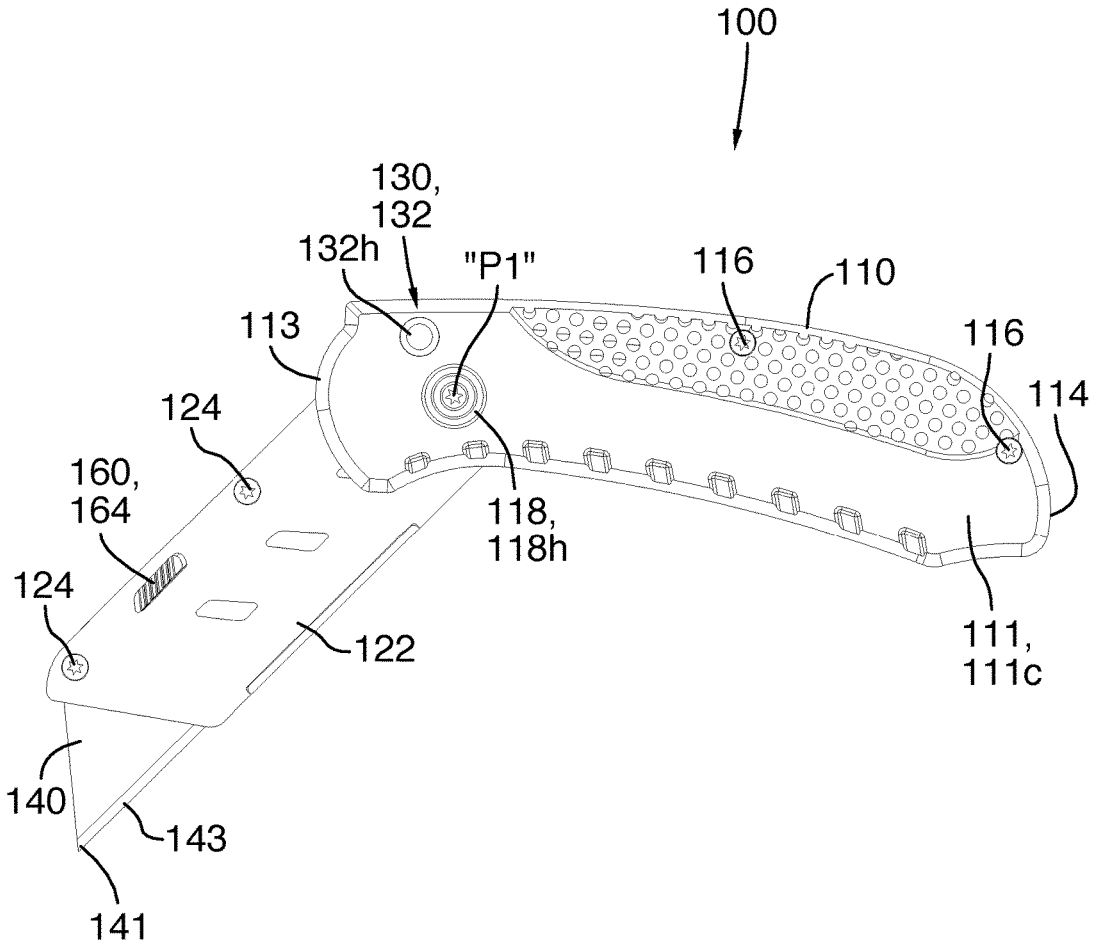
FIG. 5 is a left side elevational view of the first illustrated embodiment of the folding utility knife of FIG. 1, with the blade holder in an intermediate position.
Figure 6:
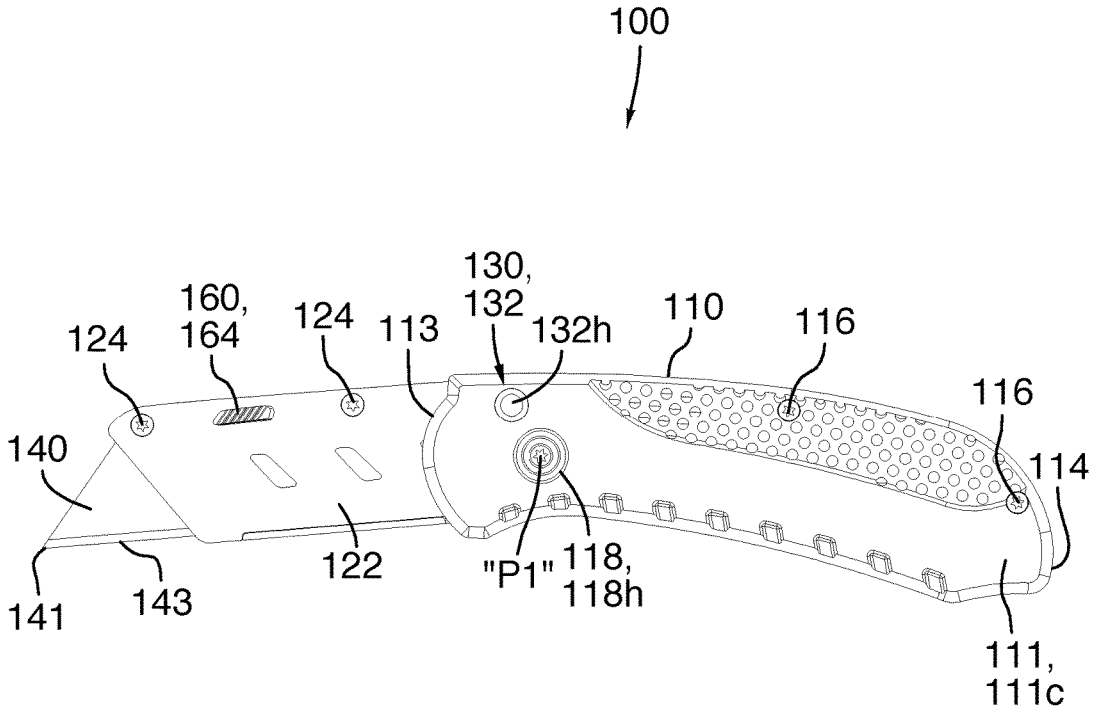
FIG. 6 is a left side elevational view of the first illustrated embodiment of the folding utility knife of FIG. 1, with the blade holder in a fully open position.
Figure 7:
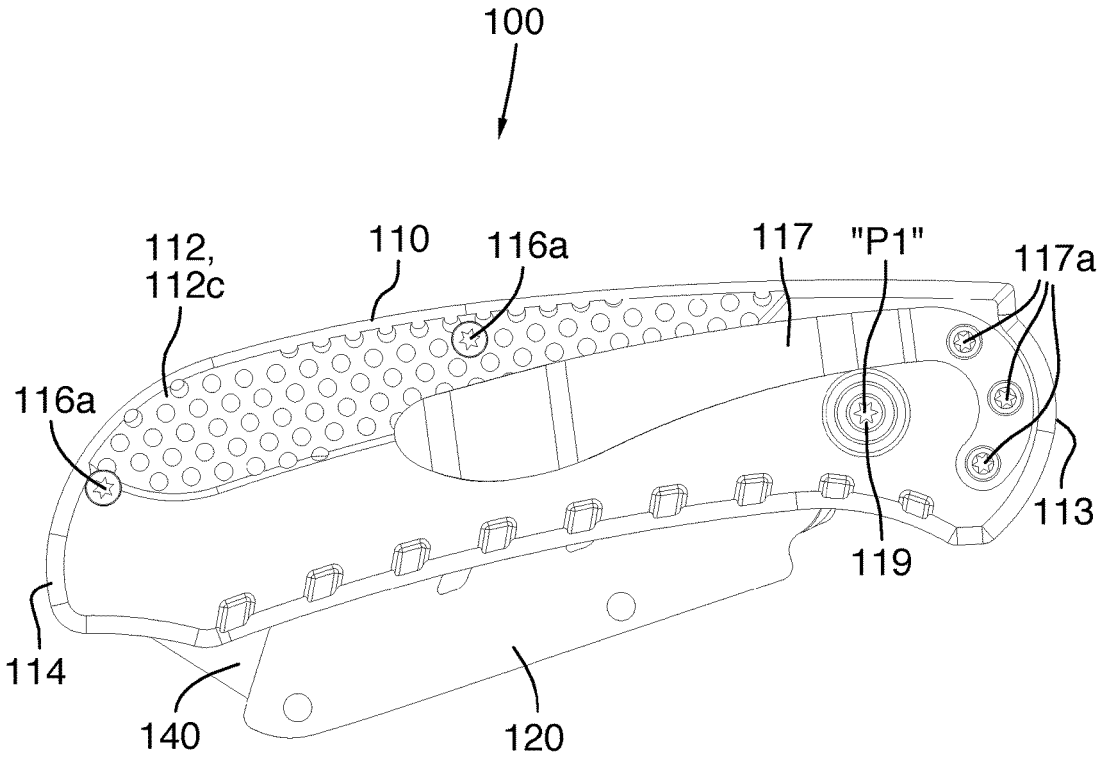
FIG. 7 is a right side elevational view of the first illustrated embodiment of the folding utility knife of FIG. 1, with the blade holder in a fully closed configuration.
Figure 8:
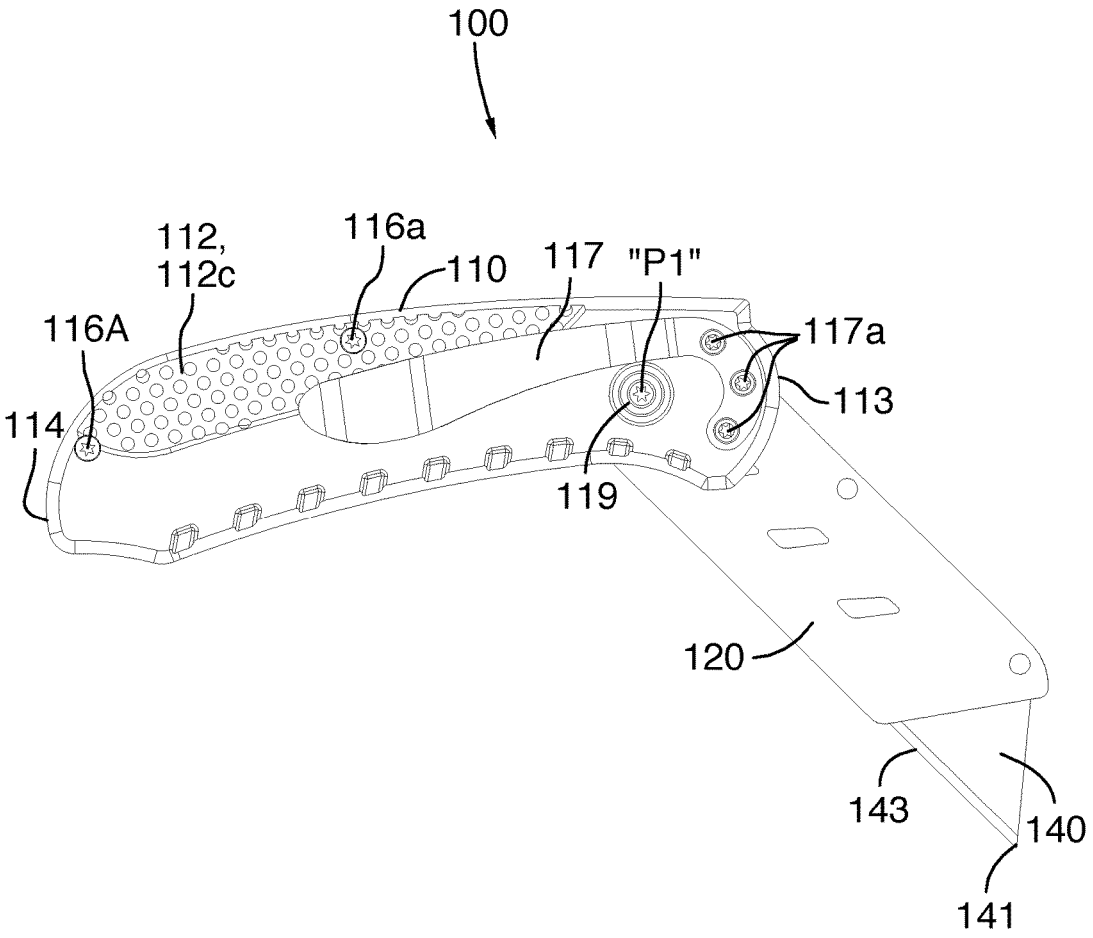
FIG. 8 is a right side elevational view of the first illustrated embodiment of the folding utility knife of FIG. 1, with the blade holder in an intermediate position.
Figure 9:
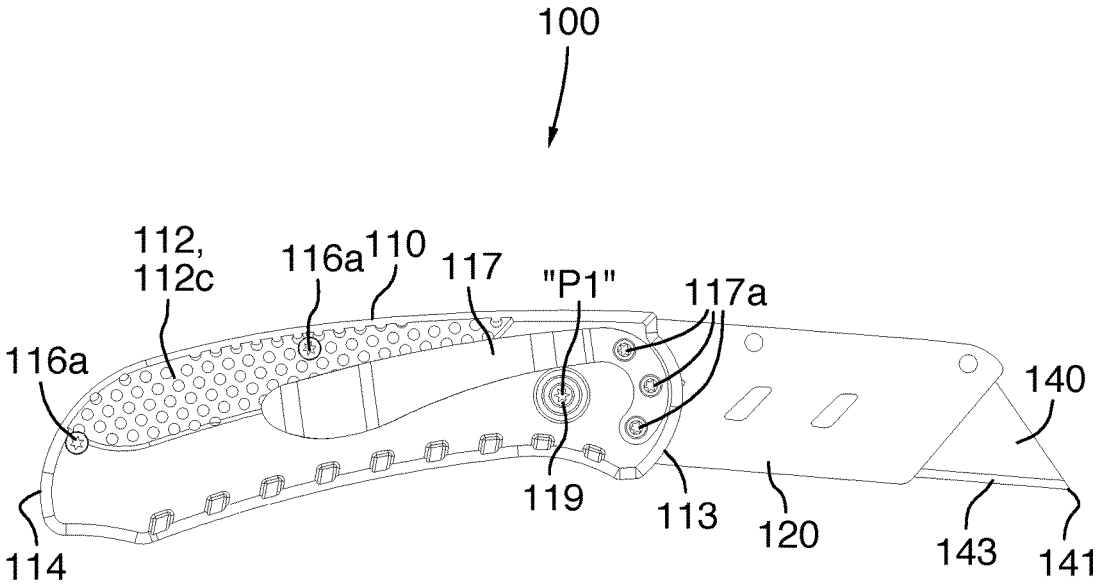
FIG. 9 is a right side elevational view of the first illustrated embodiment of the folding utility knife of FIG. 1, with the blade holder in a fully open position.

100 folding utility knife
110 handle
111 first handle portion
111*c* first cover plate
111*b* first backing side plate
112 second handle portion
112*c* second cover plate
112*b* second backing side plate
113 connection end
114 free end
115*a* first spacer
115*b* second spacer
115*c* third spacer
116 threaded fasteners
116*a* internally threaded nuts
117 spring metal clip
117*a* small threaded fasteners
118 robust pivot pin
118*h* head portion
118*s* shaft portion
119 internally threaded nut
120 blade holder
122 blade holder side plate
124 threaded fasteners
130 blade holder locking mechanism
132 pin mechanism
132*h* wider head portion
132*b* wider base portion
132*c* narrow central portion
134*a* fully closed locking indent
134*b* intermediate locking indent
134*c* fully open locking indent
140 cutting blade
141 first blade end
142 second blade end
143 cutting edge
144 indexing edge
150 plurality of indexing notches
151 first indexing notch
152 second indexing notch
153 third indexing notch
160 blade locking mechanism
162 locking pin
164 manually operable button
166 leaf spring
"A" axis
"H" Horizontal plane
"P1" blade holder pivot axis
"R" arrow
200 folding utility knife
211 first handle portion
212 second handle portion
218 blade holder bearing member
218*p* pin member
218*h* head portion
218*s* shaft portion
220 blade holder
222 first threaded fastener
224 lateral bearing member
224*h* head portion
224*s* shaft portion
224*t* top portion
240 cutting blade
241 first blade end
242 second blade end
"G" blade receiving gap
"P2" blade holder pivot axis

DETAILED DESCRIPTION OF THE ILLUSTRATED EMBODIMENTS

Figure 19:
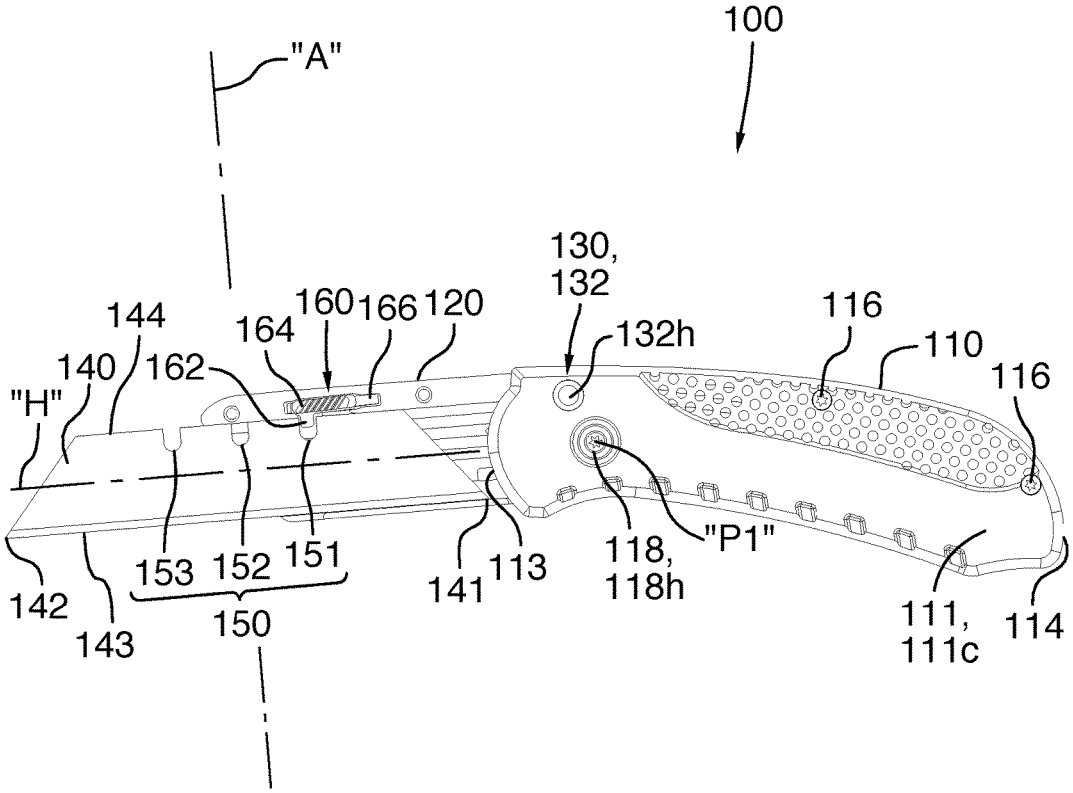
FIG. 19 is a left side elevational view of the first illustrated embodiment of the folding utility knife of FIG. 1, with the blade holder in a fully open position, and with the blade holder cover removed for the sake of clarity and the cutting blade in a sixth blade position wherein the second end and a second longer portion of the cutting edge is exposed for use.
Figure 20:
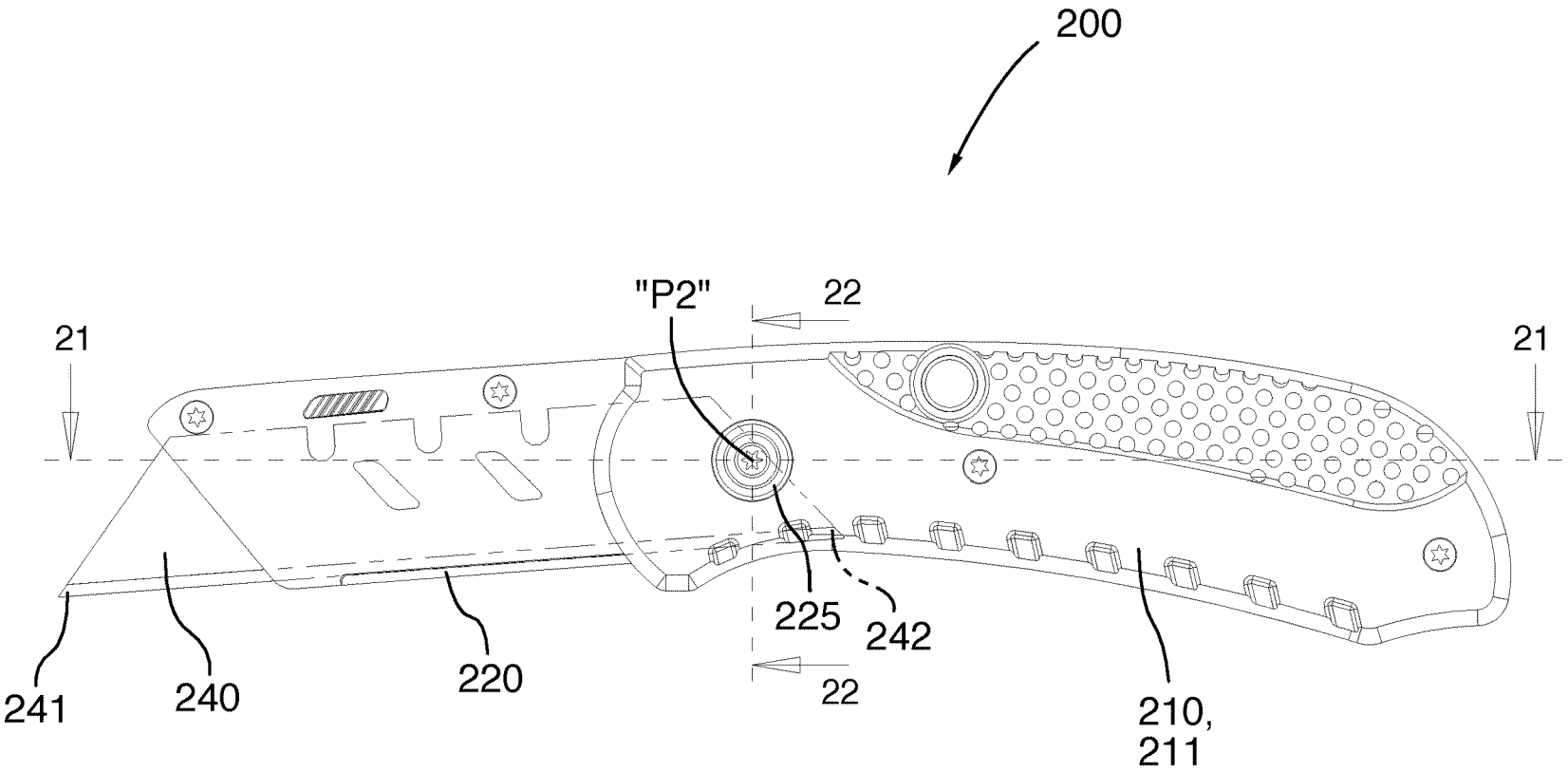
FIG. 20 is a left side elevational view of a second illustrated embodiment of a folding utility knife according to the present invention, with the blade holder in a fully open position and with the portion of the cutting blade held within the blade holder shown in phantom outline.
Figure 21:
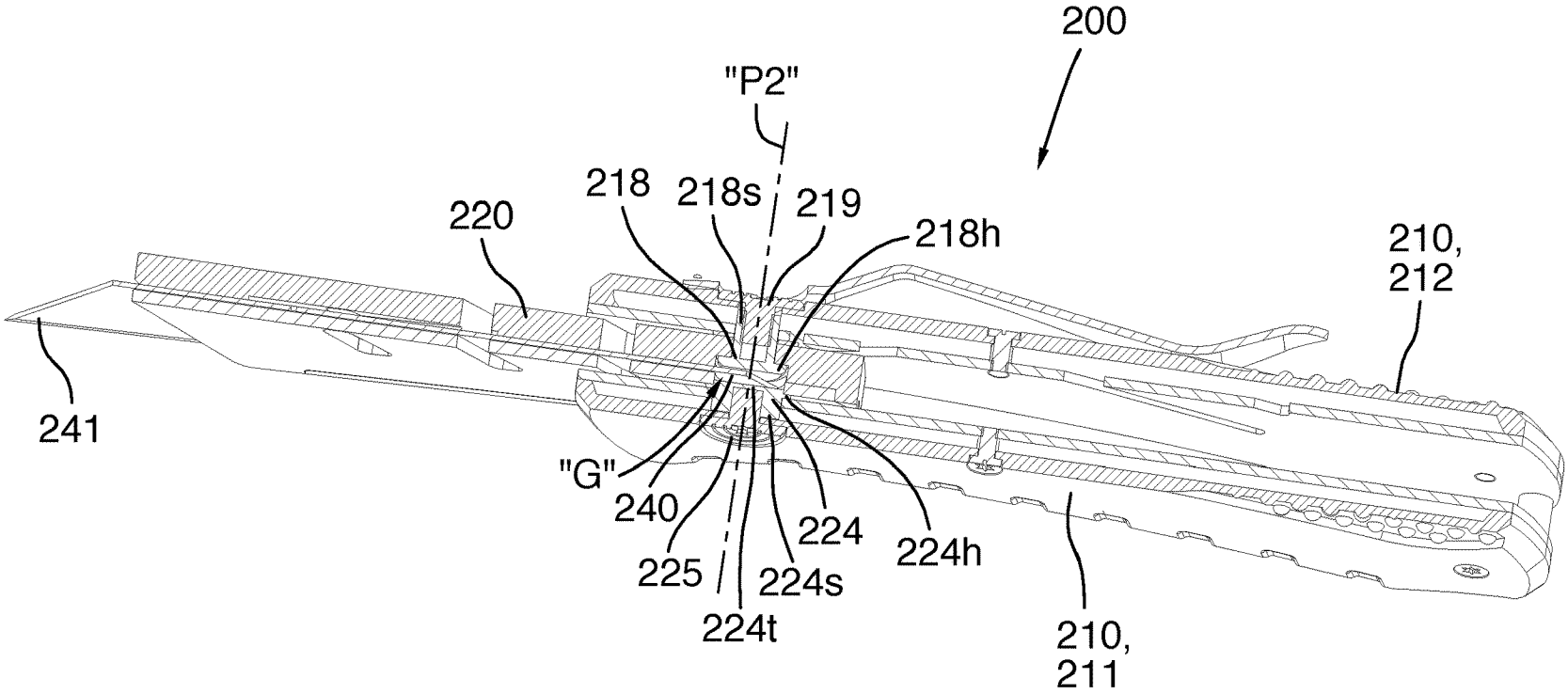
FIG. 21 is a cutaway perspective view from above of the second embodiment of FIG. 20, taken along section line 21-21 of FIG. 20; and, FIG. 22 is a cutaway perspective view from the rear of the second embodiment of FIGS. 21 and 22, taken along section line 22-22 of FIG. 20.
Figure 22:
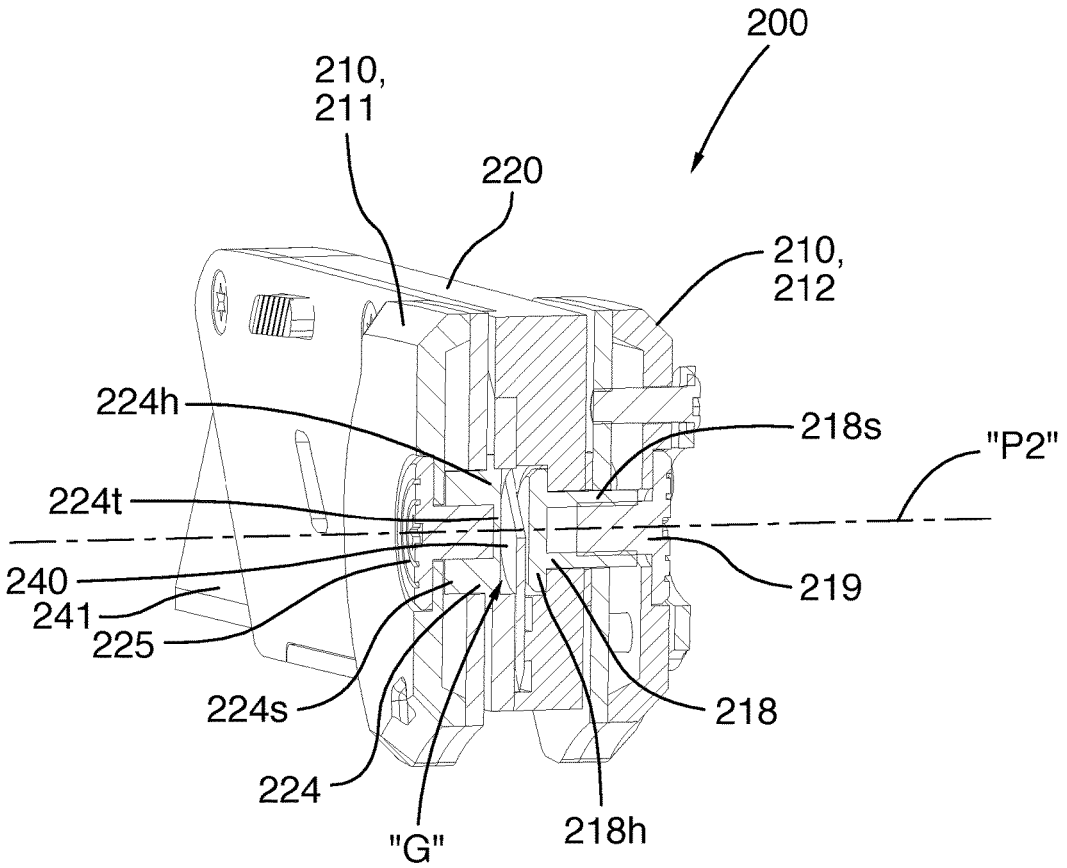

Referring to FIGS. 1 through 22 of the drawings, it will be noted that FIGS. 1 through 19 illustrate a first illustrated embodiment of folding utility knife according to the present invention, and FIGS. 20 through 22 illustrate a second illustrated embodiment of folding utility knife according to the present invention.

Reference will now be made to FIGS. 1 through 19, which show a first illustrated embodiment of the folding utility knife according to the present invention, as indicated by the general reference numeral 100. The first illustrated embodiment folding utility knife 100 is for performing various household and commercial cutting functions, such as cutting carpet, cutting twine, cutting drywall, trimming roofing shingles, slicing fiberglass insulation, cutting vinyl flooring, slitting, plastic sheeting, slicing through dried caulking, cutting foam board, slitting cable insulation, and so on. The first illustrated embodiment folding utility knife 100 performs these types of functions, but performs such functions in a manner superior to the prior art for reasons including, but not limited to, the knife blade, also known as the cutting blade 140, being longitudinally slidable to a plurality of in-use blade positions with the blade locking mechanism 160 of the cutting blade 140 selectively engaging each of a plurality of indexing notches 150 in the indexing edge 144 of the cutting blade 140 to hold fast the cutting blade in each one of said plurality of in-use blade positions, such that the folding utility knife 100 can, by reason of providing such plurality of blade positions, effectively cut through both thin and thick workpieces, and wherein the useful life of the cutting blade 140 is extendable over that of prior art folding knives, due to the exposure of extra cutting edge length in several of said plurality of in-use blade positions.

In brief, the first illustrated embodiment folding utility knife 100 according to the present invention comprises a handle 110, a blade holder 120, a blade holder locking mechanism 130, a cutting blade 140, a plurality of indexing notches 150, and a blade locking mechanism 160. The present invention will now be described in greater detail below.

The first illustrated embodiment folding utility knife 100 comprises a handle 110 having a connection end 113 and a free end 114. The blade holder 120 includes a blade holder side plate 122 secured to the blade holder 120 by threaded fasteners 124. Together, the blade holder 120 and the blade holder side plate 122 enclose the cutting blade 140, which blade holder is operatively mounted on the handle 110 adjacent the connection end 113, as will be discussed in greater detail subsequently. The handle 110 has a first handle portion 111 and a second handle portion 112 disposed in laterally spaced relation one from the other such that the blade holder 120, which is carrying the cutting blade 140, fits between the first handle portion 111 and the second handle portion 112. The first handle portion 111 comprises a first cover plate 111*c* and a first backing side plate 111*b*. Similarly, the second handle portion 112 comprises a second cover plate 112*c* and a second backing side plate 112*b*.

The first handle portion 111 and the second handle portion 112 are retained in such spaced relation by a first spacer 115*a* disposed adjacent the free end 114 of the handle 110, a second spacer 115*b* disposed generally centrally on the handle 110, and a third spacer 115*c* disposed adjacent the connection end 113 of the handle 110. Two threaded fasteners 116 and co-operating internally threaded nuts 116*a* are used to secure the first handle portion 111, the second handle portion 112, the first spacer 115*a*, the second spacer 115*b* and the third spacer 115*c* securely together.

A spring metal clip 117 for attachment to the clothing of a user is optionally secured to the second handle portion 112 adjacent the connection end 113 of the handle 110 by three small threaded fasteners 117*a*, so as to extend from the connection end 113 of the handle 110 towards the free end 114 of the handle 110. Any suitable size, length, and shape of clip 117 can be used.

The blade holder 120 is mounted on the handle 110 for angular movement relative to the handle 110 between a fully open position, as can be best seen in FIGS. 3, 6, 9, 12, and 14 through 19, through an intermediate position, as can be best seen in FIGS. 2, 5, 8, and 11, and a fully closed configuration, as can be best seen in FIGS. 1, 4, 7, 10, and 13. More specifically, the blade holder 120 is pivotally mounted on the handle 110 adjacent the connection end 113, by a robust pivot pin 118 having a head portion 118*h* and a shaft portion 118*s*, for pivotal movement about a blade holder pivot axis "P1". The pivot pin 118 is received and retained at its head portion 118*h* and to the first handle portion 111 and is secured in place by an internally threaded nut 119 received and retained at the second handle portion 112.

Figure 10:
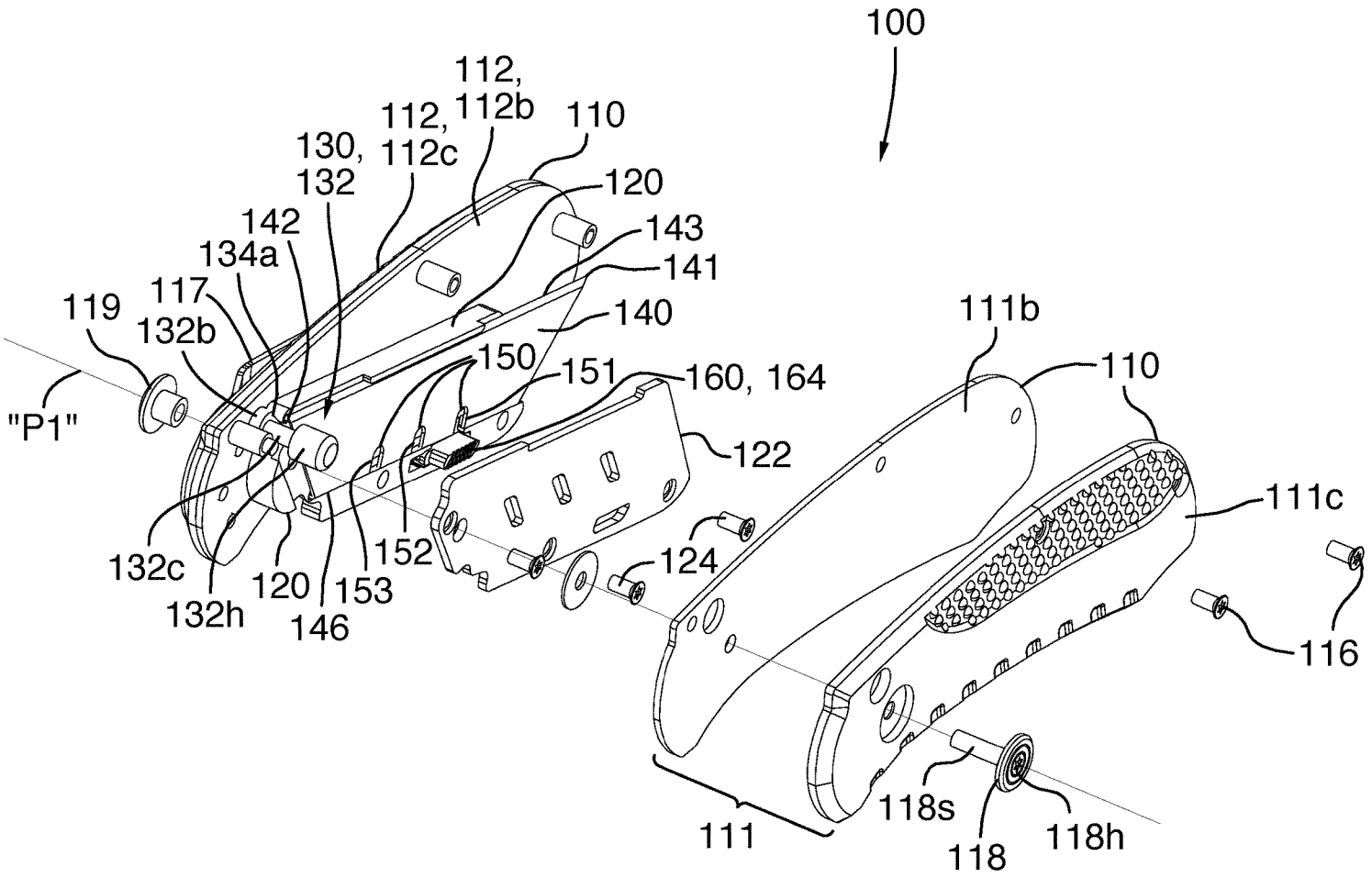
FIG. 10 is a partially exploded perspective view from the left front of the first illustrated embodiment of the folding utility knife of FIG. 1, with the blade holder in a fully closed configuration.
Figure 11:
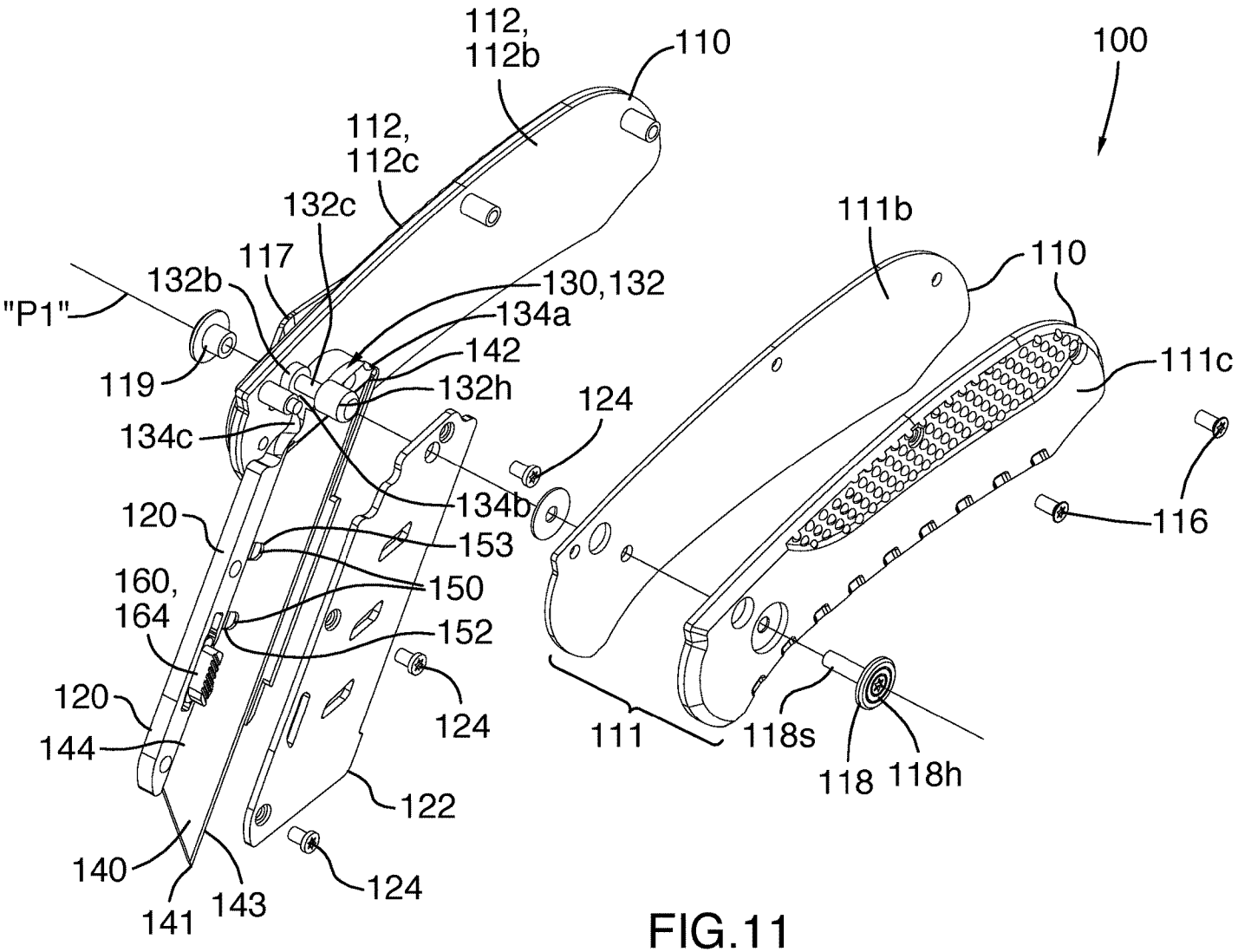
FIG. 11 is a partially exploded perspective view from the left front of the first illustrated embodiment of the folding utility knife similar to FIG. 10, but with the blade holder in an intermediate position.
Figure 12:
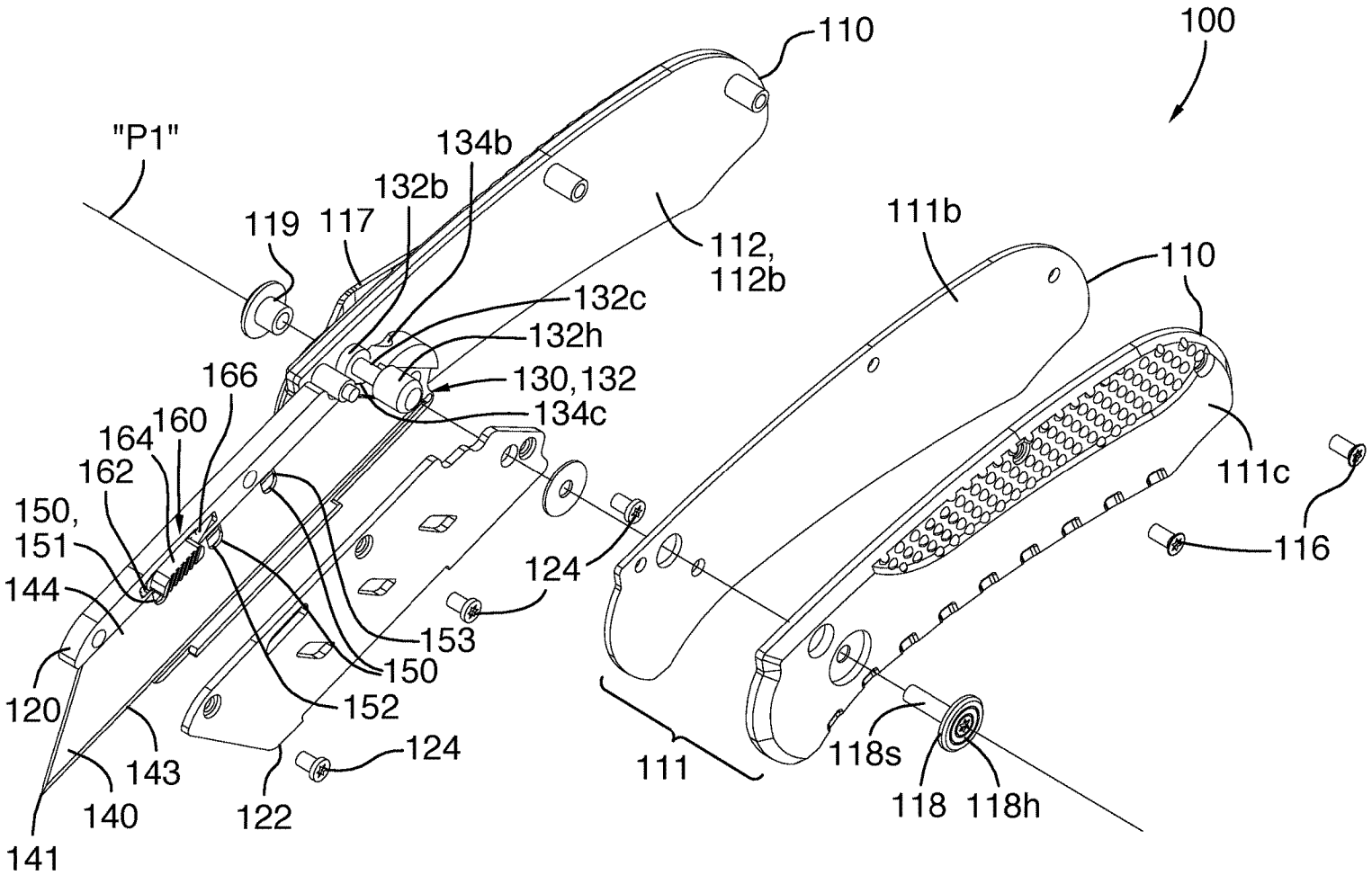
FIG. 12 is a partially exploded perspective view similar to FIG. 11, but with the blade holder in a fully open position and with the blade holder cover removed for the sake of clarity.
Figure 13:
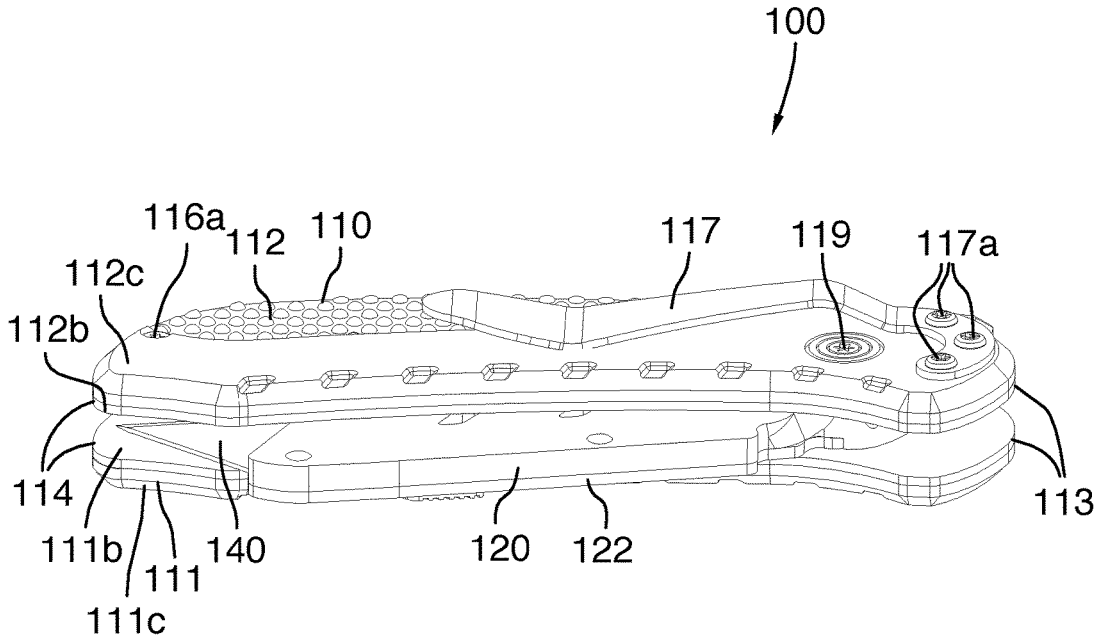
FIG. 13 is a perspective view from the bottom right of the first illustrated embodiment of the folding utility knife of FIG. 1.

A blade holder locking mechanism 130 is operatively interconnected between the handle 110 and the blade holder 120 for releasably locking the blade holder 120 at the fully open position, as can be best seen in FIGS. 3, 6, 9, 12, and 14 through 19, also releasable locking of the blade holder 120 intermediate position between the fully open position and the fully closed configuration, as can be best seen in FIGS. 2, 5, 8, and 11, and also releasable locking of the blade holder 120 in the fully closed configuration, as can be best seen in FIGS. 1, 4, 7, 10, and 13. The blade holder locking mechanism 130 comprises a spring-loaded pin mechanism 132 that has a wider head portion 132*h* that protrudes outwardly from and is slidably retained by the first handle portion 111, a narrow central portion 132*c* that extends into the space between the first handle portion 111 and the second handle portion 112, and a wider base portion 132*b* that is slidably retained by the second handle portion 112. A coil spring recessed in the second handle portion 112 (not specifically shown) biases the pin mechanism 132 to a rest position, which is also a locking position, whereat the head portion of the pin mechanism 132 extends outwardly from the first handle portion 111 so as to be manually accessible, and at least a portion of the base portion extends into the space between the first handle portion 111 and the second handle portion 112. Correspondingly, the blade holder 120 has three cooperating locking indents, namely a fully closed locking indent 134*a*, as indicated in FIGS. 10 and 11, an intermediate locking indent 134*b*, as indicated in FIGS. 11 and 12, and a fully open locking indent 134*c*, as indicated in FIGS. 11 and 12. In the locking position, the wider base portion 132*b* is positioned to enter an aligned one of the locking indents 134*a*, 134*b*, 134*c*, so as to substantially preclude pivotal movement of the blade holder 120. When the pin mechanism 132 is displaced inwardly by pushing on the head portion 132*h*, the base portion 132*b* moves into the second handle portion 112 and accordingly is removed from the engaged one of the locking indents 134*a*, 134*b*, 134*c*. Subsequent to the removal of the wider base portion 132*b* from the corresponding one of the fully closed locking indent 134*a*, the intermediate locking indent 134*b*, the fully open locking indent 134*c*, the blade holder 120 can be selectively moved between the fully open position, the intermediate position, and the fully closed configuration, and locked in those positions.

A novel cutting blade 140 extends longitudinally between a first blade end 141 and a second blade end 142. The cutting blade 140 has a cutting edge 143 that extends between the first blade end 141 and the second blade end 142. The cutting edge 143 is disposed in opposed parallel relation to an indexing edge 144 that is shorter than the cutting edge 143 due to the centrally, inwardly angled orientation of the cutting blade 140 at the first blade end 141 and the second blade end 142.

The indexing edge 144 has a plurality of notches 150 therein. In the first illustrated embodiment, the indexing edge 144 has a first indexing notch 151, a second indexing notch 152 and a third indexing notch 153 spaced from one another along the indexing edge 144. More specifically, in the novel cutting blade 140 illustrated, the first indexing notch 151, the second indexing notch 152 and the third indexing notch 153 are equally spaced one from the next adjacent notch along the indexing edge 144. The second indexing notch 152 is centrally spaced between the first blade end 141 and the second blade end 142 of the cutting blade 140. Further, the first indexing notch 151 and the second indexing notch 152 are spaced equal distances from the first blade end 141 and the second blade end 142, respectively, of the cutting blade 140. In this manner, the cutting blade 140 is readily reversible in end to end relation within the blade holder 120, for rotation of the cutting blade 140 through one hundred eighty (180) degrees of rotation in a horizontal plane "H", about a vertical axis "A" that passes through and is perpendicular to both the cutting edge 143 and the indexing edge 144 of the cutting blade 140. Such reversal of the orientation of the cutting blade 140 allows for maximization of the use of the cutting blade 140, or in other words full use of the entire cutting edge 143.

The blade locking mechanism 160 has a locking pin 162 mounted on the blade holder 120 for locking engagement with a selected one of the first indexing notch 151, the second indexing notch 152, and the third indexing notch 153 to hold fast the cutting blade 140 against longitudinal sliding movement within the blade holder 120. As can be best seen in FIGS. 10 through 12 and 14 through 19, the blade locking mechanism 160 comprises a manually operable button 164 mounted on the blade holder 120 and a leaf spring 166 mounted on the blade holder 120 in biasing relation with the button 164. Manual pressing on the button 164 against the biasing of the leaf spring 166 removes the locking pin 162 from engagement of any one of the first indexing notch 151, the second indexing notch 152, third indexing notch 153, thereby permitting the cutting blade 140 to be slid parallel to its longitudinal axis and the longitudinal axis of the blade holder within the blade holder 120, including being slid into, or out of, the blade holder 120.

As can readily be seen in FIGS. 14 through 19, the blade holder locking mechanism 130 holds fast the cutting blade 140 against longitudinal sliding movement within the blade holder 120.

Figure 14:
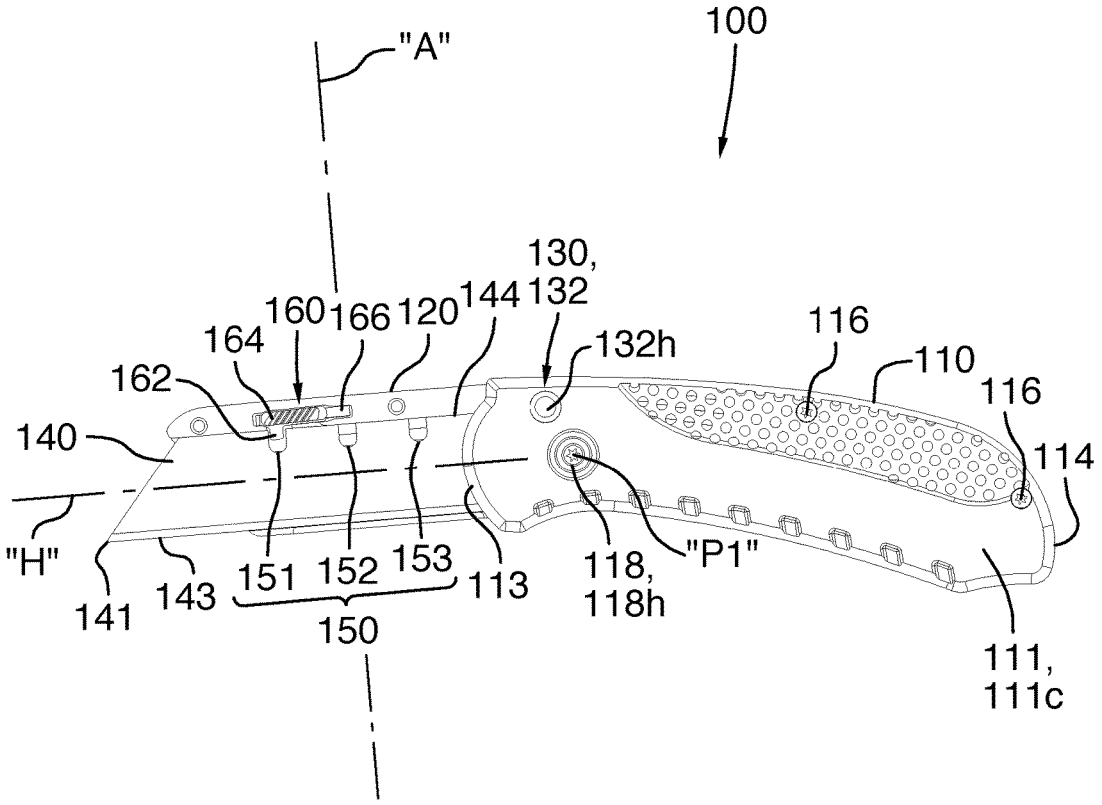
FIG. 14 is a left side elevational view of the first illustrated embodiment of the folding utility knife of FIG. 3, with the blade holder in a fully open position, and with the blade holder cover removed for the sake of clarity and the cutting blade in a first blade position wherein the first end and a first short portion of the cutting edge of the cutting blade is exposed for use.
Figure 15:
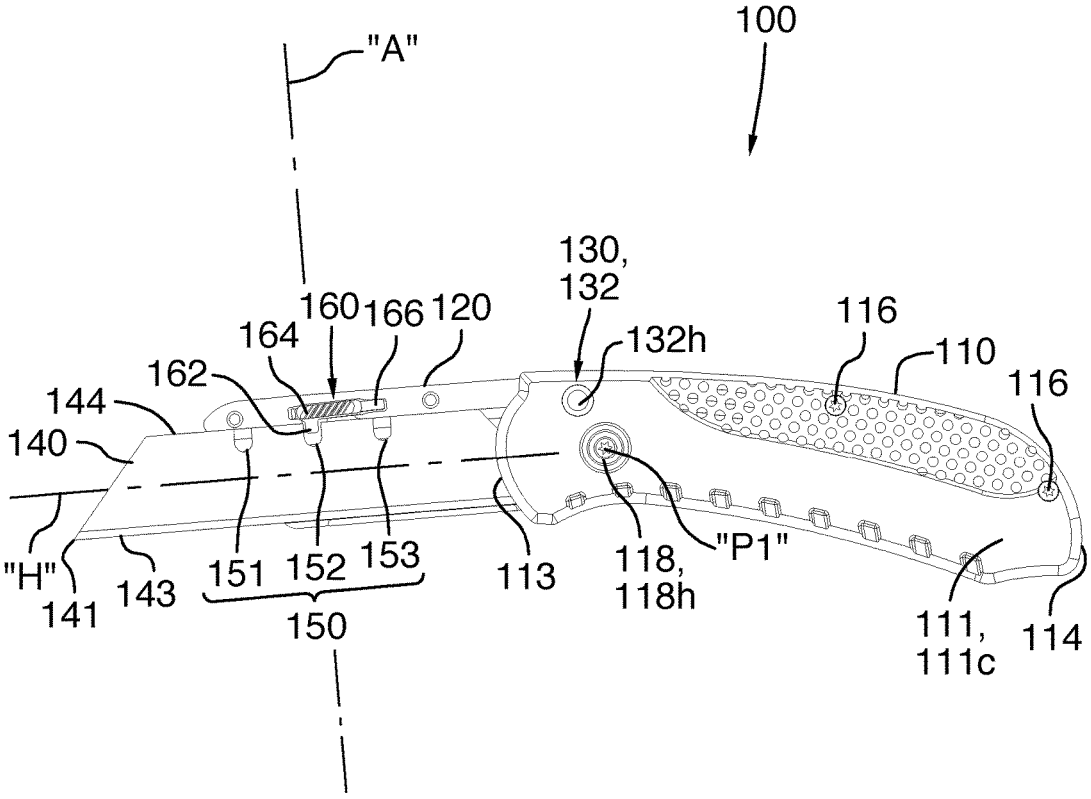
FIG. 15 is a left side elevational view of the first illustrated embodiment similar to FIG. 14, but with the blade holder in a fully open position, and with the blade holder cover removed for the sake of clarity and the cutting blade in a second blade position wherein the first end and a first intermediate portion of the cutting edge of the cutting blade is exposed for use.
Figure 16:
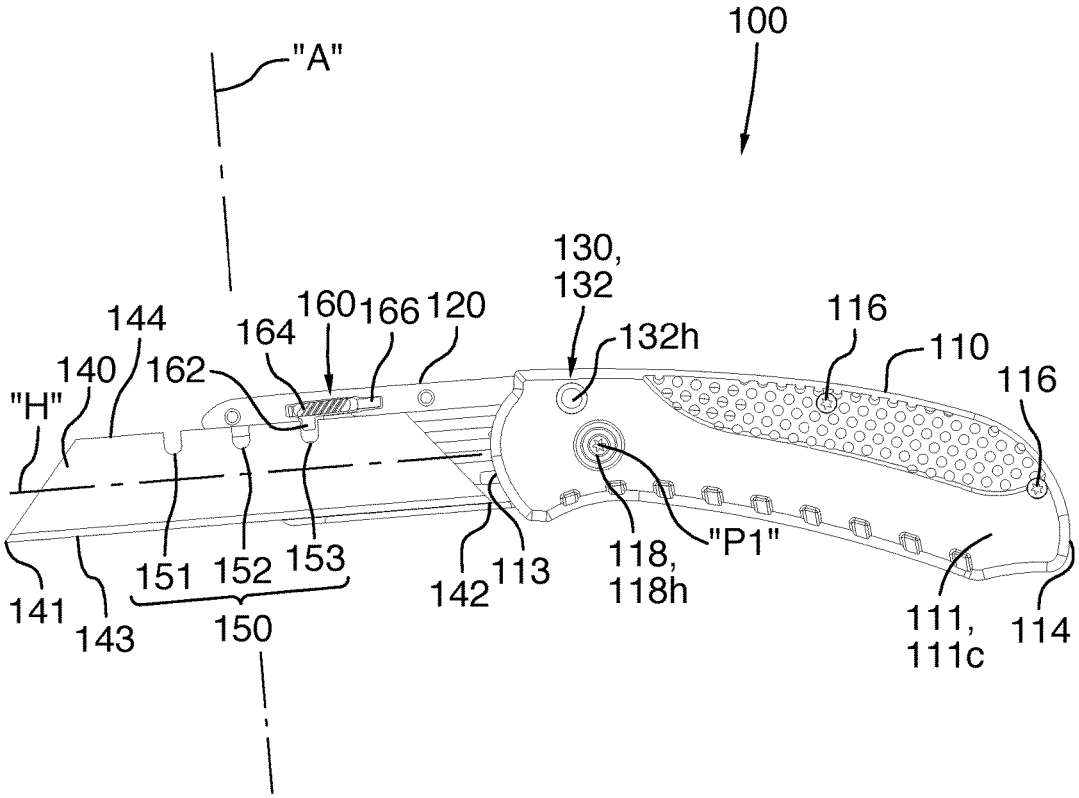
FIG. 16 is a left side elevational view of the first illustrated embodiment similar to FIG. 15, but with the blade holder in a fully open position, and with the blade holder cover removed for the sake of clarity and the cutting blade in a third blade position wherein the first end and a first longer portion of the cutting edge of the cutting blade is exposed for use.

Specifically, as can readily be seen in FIGS. 14 through 16, the blade holder locking mechanism 130 holds fast the cutting blade 140 against longitudinal sliding movement within the blade holder 120 such that the following occurs.

As can be readily seen in FIG. 14, locking engagement of the locking pin 162 with the first indexing notch 151 holds the cutting blade 140 against the longitudinal sliding movement in a first blade position wherein the first blade end 141 and a first short portion of the cutting edge 143 is exposed for use outside of the free end of the blade holder 120.

As can be readily seen in FIG. 15, locking engagement of the locking pin 162 with the second indexing notch 152 holds the cutting blade 140 against the longitudinal movement in a second blade position wherein the first blade end 141 and a first intermediate portion of the cutting edge 143 is exposed for use outside of the free end of the blade holder 120.

As can be readily seen in FIG. 16, locking engagement of the locking pin 162 with the third indexing notch 153 holds the cutting blade 140 against the longitudinal movement in a third blade position wherein the first blade end 141 and a first longer portion of the cutting edge 143 is exposed for use outside of the free end of the blade holder 120.

Figure 17:
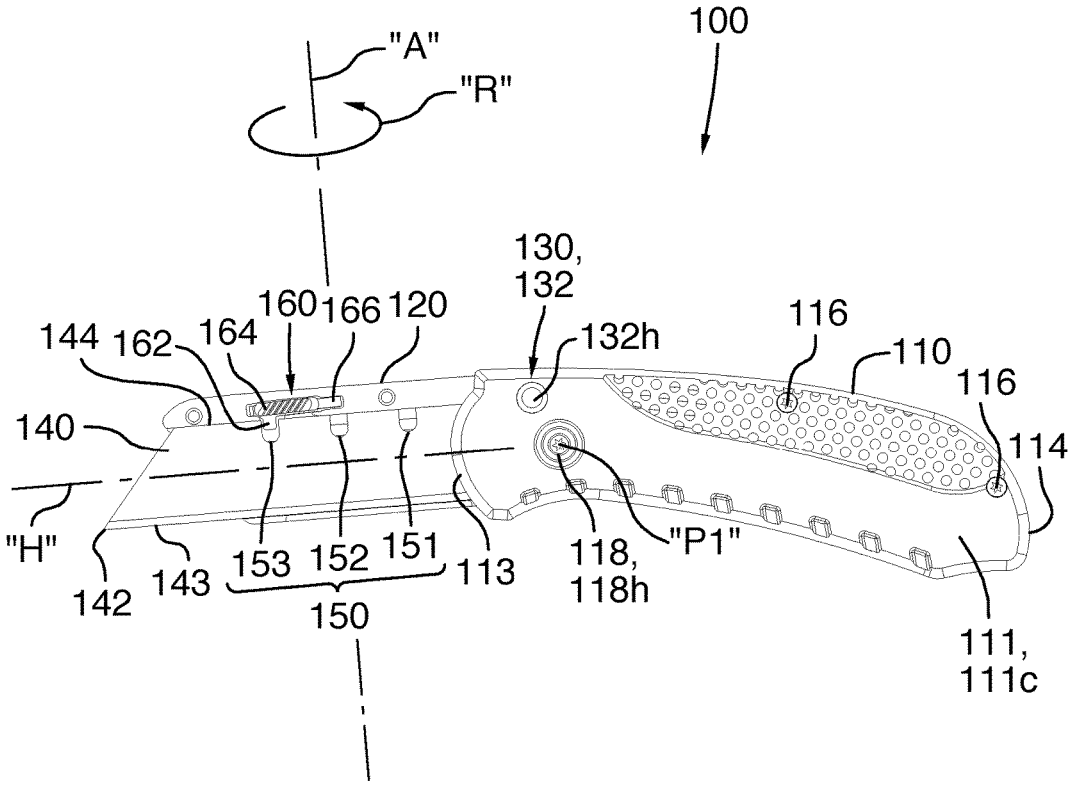
FIG. 17 is a left side elevational view of the first illustrated embodiment of the folding utility knife similar to FIG. 14, but with the cutting blade shown in a fourth blade position wherein the second end and a second short portion of the cutting edge is exposed for use.
Figure 18:
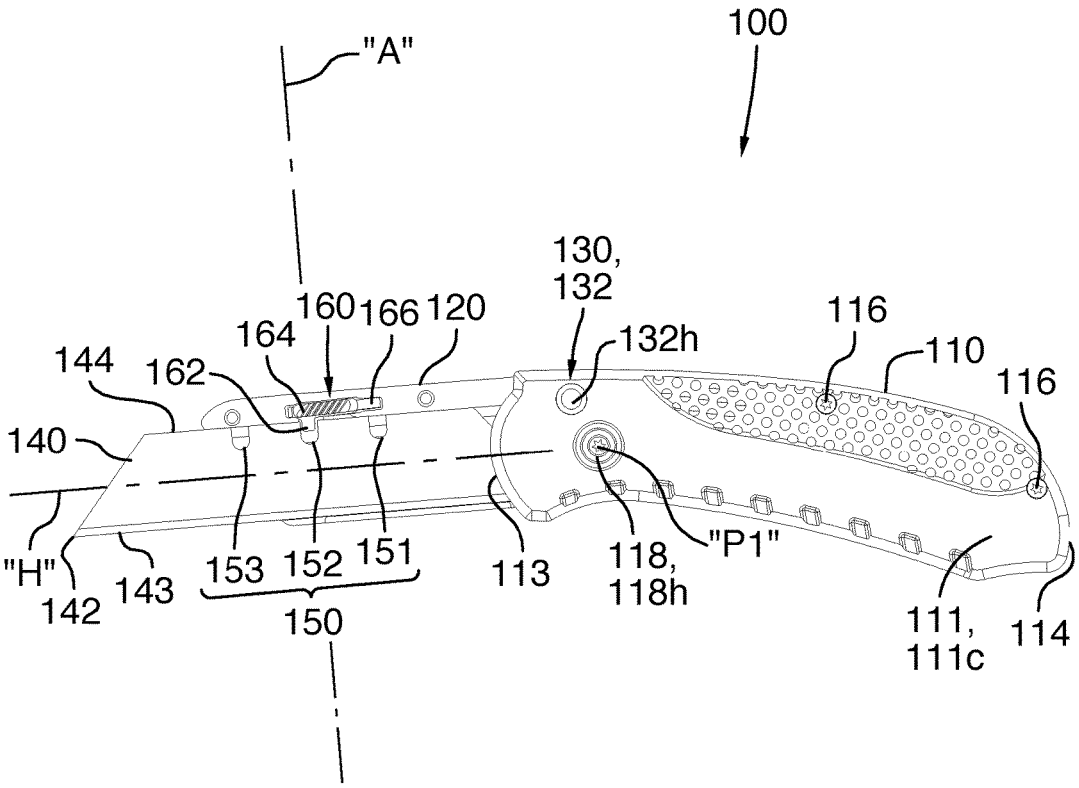
FIG. 18 is a left side elevational view of the first illustrated embodiment of the folding utility knife similar to FIG. 15, but the cutting blade shown in a fifth blade position wherein the second end and a second intermediate portion of the cutting edge is exposed for use.

In addition to using over half of the length of the cutting edge 143 of the cutting blade 140 as described with reference to FIGS. 14 through 16, the orientation of the cutting blade 140 may be reversed through one hundred eighty (180) degrees of rotation in the horizontal plane "H", about the axis "A", as described above, and as shown by arrow "R" in FIG. 17, to allow for maximization of the use of the cutting blade 140, or in other words, full use of the entire cutting edge 143. The cutting blade 140 is releasable from the locking engagement in the first, second and third blade positions to permit removal of the cutting blade 140 from the blade holder 120 to permit said rotation of the cutting blade 140 through one hundred eighty (180) degrees of rotation in a horizontal plane about the axis "A", for re-insertion of the first blade end 141 into the blade holder 120 in the reversed orientation, as shown in FIGS. 17 through 19. As can be readily seen, in the reversed blade orientation, three additional cutting blade positions are available. More specifically, the cutting blade 140 can be positioned in a fourth cutting blade position, as can be best seen in FIG. 17, a fifth cutting blade position, as can be best seen in FIG. 18, and a sixth cutting blade position, as can be best seen in FIG. 19, and whereat the following occurs.

As can be readily seen in FIG. 17, locking engagement of the locking pin 162 with the third indexing notch 153 holds the cutting blade 140 against the longitudinal movement in a fourth blade position wherein the second end 142 and a second short portion of the cutting edge 143 is exposed for use outside of the free end of the blade holder 120.

As can be readily seen in FIG. 18, locking engagement of the locking pin 162 with the second indexing notch 152 holds the cutting blade 140 against the longitudinal movement in a fifth blade position wherein the second end 142 and a second intermediate portion of the cutting edge 143 is exposed for use outside of the free end of the blade holder 120.

As can be readily seen in FIG. 19, locking engagement of the locking pin 162 with the first indexing notch 151 holds the cutting blade 140 against the longitudinal movement in a sixth blade position wherein the second end 142 and a second longer portion of the cutting edge 143 is exposed for use outside of the free end of the blade holder 120.

It should be generally noted that with utility type folding knives, it is often desirable in the performance of certain tasks to utilize a removable cutting blade that has a longer cutting edge than is presently available in prior art utility knives. So-called snap-off blades (e.g., those sold under the well-known OLFA trademark) have been invented for this purpose. However snap-off blades of this general type have not proven satisfactory for many applications, perhaps due to the inherent lack of robustness caused by the scoring lines that are necessary to provide for the snap-off feature. As such, there remains a need in the art for interchangeable solid and robust utility knife cutting blades having a more conventional configuration that can provide for a longer cutting edge to be exposed from the blade holder during use. At first blush, in order to provide a removable and reversible cutting blade with a cutting edge that is longer than that found in conventional cutting blades, it might seem to be a matter of simply making a longer cutting blade. Unfortunately, this lengthening has the effect of also requiring lengthening of the overall length of the blade holder to operatively accommodate a longer cutting blade. However, with foldable utility knives, such as illustrated above in relation to the first embodiment, the length of the handle into which the blade holder must fold for storage in the fully closed configuration (which configuration is shown in, for example, FIG. 4) must also be proportionally increased to accommodate a longer blade holder nested therewithin. This is so, as the cutting blade must typically be retracted to either the first blade position or the fourth blade position (depending on the rotational orientation of the cutting blade) upon folding to the fully closed configuration of the utility knife. As contact of the innermost end of the cutting blade 140 with the pivot pin 118 ultimately limits longitudinal retraction into the blade holder, efforts to reduce the overall length of foldable utility knives (particularly those intended to have utility as "pocket knives") are limited by such contact. Thus, it is a further object of the present invention to provide an increased length cutting blade in a folding utility knife without a proportionate increase in the length of the blade holder or of the handle that contains same in the folded fully closed configuration.

In the present invention, provision of an increased length cutting blade (as compared with standard quadrilateral-shaped utility blades of the prior art) in a folding utility knife without a proportionate increase in the length of the blade holder or the handle is taught in a second illustrated embodiment of a folding utility knife according to the present invention, as indicated by the general reference numeral 200, and as illustrated in FIGS. 20 through 22. The second illustrated embodiment folding utility knife 200 is similar to the first illustrated embodiment folding utility knife 100, except that the second illustrated embodiment folding utility knife 200 accommodates the longer than prior art cutting blade 240 without a proportionate increase in the length of the handle 210 and the blade holder 220.

In order to efficiently accommodate the longer length cutting blade 240 as aforesaid, a rearmost portion of the end of the cutting blade 240 extends transversely through the blade holder pivot axis "P2", or alternatively phrased, the blade holder pivot axis "P2" extends transversely through a rearmost portion of the end of the cutting blade 240 when the cutting blade is retracted to at least the third and sixth blade positions. In order to accommodate this, the pivot pin of the second embodiment has been made discontinuous along the blade holder pivot axis "P2". More specifically, the continuous blade holder bearing member 118 of the first illustrated embodiment of folding utility knife 100 has been replaced by a first blade holder bearing member 218 securely mounted on the second handle portion 212 so as to project into the space between the first handle portion 211 and the second handle portion 212 towards the second handle portion 212, and such that the blade holder pivot axis "P2" extends through the first blade holder bearing member 218. In this manner, the blade holder 220 is mounted in pivotal relation on the first blade holder bearing member 218 for pivotal movement about the blade holder pivot axis "P2".

The first blade holder bearing member 218 preferably comprises, as shown in FIGS. 20 to 22, a head portion 218*h* and a shaft portion 218*s*. The pin member 218*p* is secured in place by a first threaded fastener 219 that threadably engages a cooperating internal thread on the shaft portion 218*s* of the first blade holder bearing member 218.

Further, a second blade holder bearing member 224 is preferably securely mounted on the other one of the first handle portion 211 and the second handle portion, specifically on the first handle portion 211, and more specifically on the blade holder side plate 222, so as to project into the space between the first handle portion 211 and the second handle portion 212 towards the first handle portion 212, and such that the blade holder pivot axis "P2" also extends through the second blade holder bearing member 218. In this manner, the blade holder 220 is also mounted in pivotal relation on the second blade holder bearing member 224 for pivotal movement about the blade holder pivot axis "P2". Moreover, the first blade holder bearing member 218 and the second blade holder bearing member 224 are disposed in axially aligned relation one with the other.

The second blade holder bearing member 224 preferably comprises, as shown in FIGS. 20 to 22, a head portion 224*h*, a shaft portion 224*s*, and a top portion 224*t*. The second blade holder bearing member 224 is secured in place by a second threaded fastener 225 that threadably engages a cooperating internal thread on the shaft portion 224*s* of the second blade holder bearing member 224. In this manner, the blade holder 220 is mounted in pivotal relation on the second blade holder bearing member 224 for pivotal movement about the blade holder pivot axis "P2".

With this arrangement, a blade receiving gap "G" is created and disposed between the first blade holder bearing member 218 and the second blade holder bearing member 224. Accordingly, when the cutting blade 240 is in the first blade position within the blade holder 220, and when the cutting blade 240 is in the fourth blade position within the blade holder 220, an end portion 242 of the cutting blade 240 is disposed in the blade receiving gap "G" between the first blade holder bearing member 218 and the second blade holder bearing member 224, such that the blade holder pivot axis "P2" extends laterally through the cutting blade 240, as can be readily seen in FIGS. 21 and 22. In this manner, the ends 241 and 242 of the cutting blade 240 can be longitudinally retracted into the blade holder 220 past the blade holder pivot axis "P2" for positioning of the cutting blade 240 within the blade holder 220 in the first and fourth blade positions before folding of the knife 200 to its fully closed configuration. This means that the length of the blade holder 220 extending forwardly of the axis "P2" can be shorter whilst fully accommodating the use of a longer cutting blade, thus shortening the overall length of the folding utility knife.

Other variations are within the spirit of the present invention. Thus, while the invention is susceptible to various modifications and alternative constructions without departing from the spirit of the inventions disclosed and claimed, only a limited number of embodiments thereof have been illustrated in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as", or, "for example") provided herein, is intended merely to better illuminate embodiments of the invention and does not pose a limitation on the scope of the invention unless otherwise claimed. No language in the specification should be construed as indicating any non-claimed element as essential to the practice of the invention.

Currently preferred embodiments of this invention are described herein. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A folding utility knife comprising:

a handle comprising a first handle portion and a second handle portion spaced from one another to define a lateral space therebetween;

a blade holder mounted in said lateral space by means of first and second blade holder bearing members securely mounted, one each, on the first and second handle portions, for pivotal movement of the blade holder relative to the handle between a fully open position and a fully closed configuration about a blade holder pivot axis;

said first and second blade holder bearing members laterally projecting towards one another across said lateral space to define a blade receiving gap between said bearing members, with the blade holder pivot axis laterally extending through said gap;

a blade holder locking mechanism operatively interconnected between the handle and the blade holder for selectively locking the blade holder at the fully open position;

a cutting blade having a first blade end and a second blade end and having a cutting edge which extends between the first blade end and the second blade end in opposed parallel relation to an indexing edge, said indexing edge having a first indexing notch, a second indexing notch and a third indexing notch spaced from one another along said indexing edge;

a blade locking mechanism having a locking pin mounted on the blade holder for locking engagement with a selected one of the first indexing notch, the second indexing notch, and the third indexing notch to hold fast said cutting blade against longitudinal sliding movement within the blade holder;

such that:

i) locking engagement of the locking pin with the first indexing notch holds the cutting blade against said longitudinal sliding movement in a first blade position wherein the first end and a first short portion of the cutting edge is exposed for use;

ii) locking engagement of the locking pin with the second indexing notch holds the cutting blade against said longitudinal movement in a second blade position wherein the first end and a first intermediate portion of the cutting edge is exposed for use;

iii) locking engagement of the locking pin with the third indexing notch holds the cutting blade against said longitudinal movement in a third blade position wherein the first end and a first longer portion of the cutting edge is exposed for use;

and such that the cutting blade is releasable from said locking engagement in said first, second and third blade positions to permit removal of the cutting blade from the blade holder and for rotation of the cutting blade through 180 degrees of rotation in a horizontal plane for re-insertion of said first end into the blade holder whereat:

iv) locking engagement of the locking pin with the third indexing notch holds the cutting blade against said longitudinal movement in a fourth blade position wherein the second end and a second short portion of the cutting edge is exposed for use;

v) locking engagement of the locking pin with the second indexing notch holds the cutting blade against said longitudinal movement in a fifth blade position wherein the second end and a second intermediate portion of the cutting edge is exposed for use; and, vi) locking engagement of the locking pin with the first indexing notch holds the cutting blade against said longitudinal movement in a sixth blade position wherein the second end and a second longer portion of the cutting edge is exposed for use; and, vii) when the cutting blade is in the first blade position, or when the cutting blade is in the fourth blade position, a portion of the cutting blade is disposed in the blade receiving gap such that the blade holder pivot axis extends transversely through the cutting blade.

2. The folding utility knife according to claim 1, wherein the blade holder bearing member comprises a pin member having a head portion and a shaft portion.

3. The folding utility knife according to claim 2, wherein the pin member is secured in place by a first threaded fastener.

4. The folding utility knife according to claim 3, further comprising a lateral bearing member securely mounted on the second handle portion so as to project outwardly towards the first handle portion, and such that the blade holder pivot axis extends through the lateral bearing member.

5. The folding utility knife according to claim 4, wherein the blade holder bearing member and the lateral bearing member are disposed in axially aligned relation one with the other.

6. The folding utility knife according to claim 1, wherein the handle has a connection end and a free end, and the blade holder is pivotally mounted on the handle, as aforesaid, adjacent the connection end.

7. The folding utility knife according to claim 1, wherein the blade holder locking mechanism is operatively interconnected between the handle and the blade holder to additionally provide for releasable locking of the blade holder in the fully closed configuration.

8. The folding utility knife according to claim 1, wherein the first indexing notch, the second indexing notch, and the third indexing notch are equally spaced one from each other.

9. The folding utility knife according to claim 1, wherein the blade locking mechanism comprises a manually operable button mounted on the blade holder and a leaf spring mounted on the blade holder in biasing relation with the button.

10. The folding utility knife according to claim 1, wherein the blade holder locking mechanism is operatively interconnected between the handle and the blade holder to additionally provide for releasable locking of the blade holder in an intermediate position between the fully open position and the fully closed configuration.

* * * * *